United States Patent [19]

Rokicki

[11] Patent Number: 4,662,110

[45] Date of Patent: May 5, 1987

[54] SLIDING DOOR ASSEMBLY

[76] Inventor: Stanley Rokicki, 112 Lake Promenade, Toronto, Ontario, Canada, M8W 1A4

[21] Appl. No.: 870,955

[22] Filed: Jun. 5, 1986

[51] Int. Cl.[4] ..... E05D 15/10

[52] U.S. Cl. ..... 49/220

[58] Field of Search ..... 49/220, 219, 218, 223, 49/129, 130

[56] References Cited

U.S. PATENT DOCUMENTS

| | | | |
|---|---|---|---|
| 2,769,214 | 11/1956 | Wright | 49/220 X |
| 3,653,153 | 4/1972 | Nagy | 49/220 |
| 3,813,814 | 6/1974 | Nagy | 49/220 |
| 4,170,845 | 10/1979 | Owen | 49/220 |
| 4,317,312 | 3/1982 | Heideman | 49/220 |
| 4,384,429 | 5/1983 | Rokicki et al. | 49/219 X |

FOREIGN PATENT DOCUMENTS 2369405 5/1978 France .

*Primary Examiner*—Philip C. Kannan

*Attorney, Agent, or Firm*—Donald E. Hewson

[57] ABSTRACT

This sliding door as disclosed is of the kind where the door moves sideways relative to the slide-track and into a recess, upon closing. The door is mounted on crank-arms, which are turned by means of a door-handle. As disclosed, the door handle also includes a latch. A first part of the motion of the handle unlatches the latch, and subsequent part of the motion of the handle turns the crank-arms. This sequence makes it possible for a further latch to be provided on the mullion side, which can be also operated by the door handle.

8 Claims, 12 Drawing Figures

SLIDING DOOR ASSEMBLY

This invention relates to sliding door assemblies of the kind that are used for example in patio doors.

BACKGROUND OF THE INVENTION

In most of the commonly known sliding door assemblies, the door simply slides on the slide track. The door is constrained against all other modes of movement apart from sliding along the line of the slide track. In such an arrangement as that it is difficult, as sliding door designers know, to provide an effective weatherseal around the closed door.

For high quality patio doors, therefore, an alternative to this "straight slide" arrangement has been developed, and the alternative has come to be known as the INLINE (trade mark) arrangement.

In the INLINE arrangement, the fixed door frame is provided with a recess. When the moving door is being moved to the closed position, the door enters this recess in a direction which is substantially perpendicular to the line of the slide track. The door has to move bodily forwardly relative to the slide track in order to enter the recess.

In the INLINE arrangement, the door does not rest directly on the slide track; instead, a pair of trolleys rest directly on the slide track and a pair of crank arms link the trolleys to the door. The arrangement is such that when the crank arms pivot, the door undergoes the required lateral movement, and the door enters the recess.

PRIOR ART

U.S. Pat. No. 4,384,429 (ROKICKI et al, May 24, 1983) is the basic patent showing a sliding door of the INLINE kind. It may be noted, however, that the door handle is the ROKICKI et al structure is not operatively connected to the crank arms.

French Pat. No. 2,369,405 (WEIKERT, May 26, 1978) also shows a sliding door that undergoes a lateral movement into the recess, which is a characteristic of the INLINE arrangement. In this patent, the act of turning the door handle operates a slide door which turns some pivot arms to move the door sideways.

U.S. Pat. No. 4,317,312 (HEIDEMANN, Mar. 02, 1982) also shows the door handle being used to control the movement of the crank arms on a door.

To the designer of sliding doors it is therefore known to control the bodily movement of the door in and out of a recess, not by manipulation of the door itself, as was shown in ROKICKI, but by manipulation of a handle.

GENERAL DESCRIPTION OF THE INVENTION

U.S. Pat. No. 4,384,429 (ROKICKI, May 24, 1983) shows a sliding door of the INLINE kind. The invention represents an improvement over the ROKICKI design, particularly as regards the use of the door handle to control the movement of the door in and out of the recess.

In the present invention, the crank arms are in operative engagement with the door handle, such that the act of turning the door handle is, in general, effective to rotate the crank arms, and therefore to move the door in and out of the recess. This may be compared with the ealier ROKICKI design where the handle was not connected to the crank arms.

The effect of this difference is that a person can open the door simply by turning the handle. A person does not have to specifically draw the door out of the recess: that action take place automatically when the door handle is turned.

This feature can be important when the door is being operated by children, or by a stranger in the house who does not perhaps realize at once that the door is of the INLINE kind. And having the door entirely under the control of the handle is of course an advantage in any event to habitual users of the door.

In the invention, the turning of the handle is not limited in its effect only to automatically drawing the door out of the recess. In the invention, turning the inside door handle is also effective to lock the door, such that the door cannot be opened then from the outside.

This object is achieved, in the invention, by dividing the full range of the handle's travel into a locked state and an unlocked state. When the handle moves in an arc, the two states comprise sectors of that arc.

In the invention, movement of the handle into the locked state is effective to actuate a locking means which locks the crank shaft to prevent the crank shaft from turning. When this happens, the outside handle cannot be used to open the door.

DETAILED DESCRIPTION OF PREFERRED EMBODIMENT

In the drawings:

FIG. 1, FIG. 2, and FIG. 3 are views looking upwards from underneath a sliding door assembly, showing the door closed, partly open, and fully open respectively;

Figure 5:
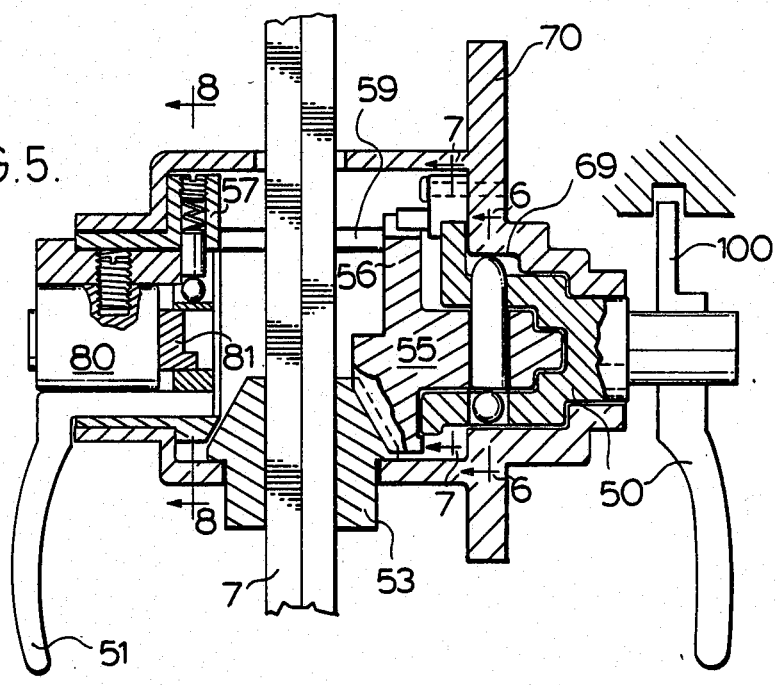
FIG. 5 is a cross section view of a door handle assembly.
Figure 6A:
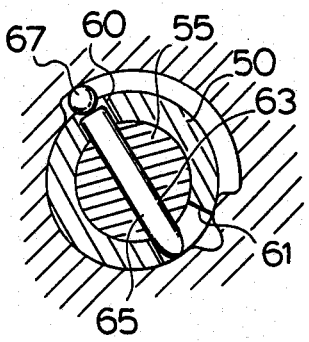
Figure 6B:
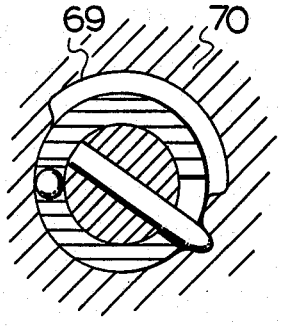
Figure 6C:
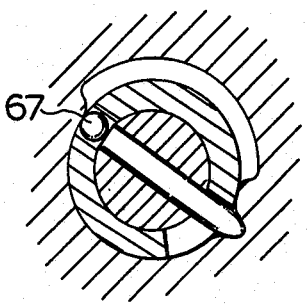
Figure 7A:
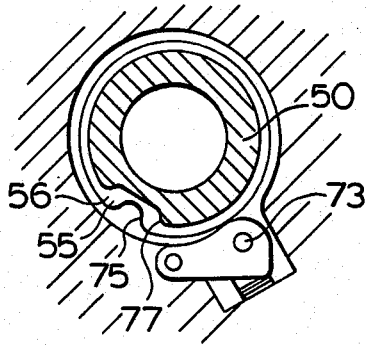
Figure 7B:
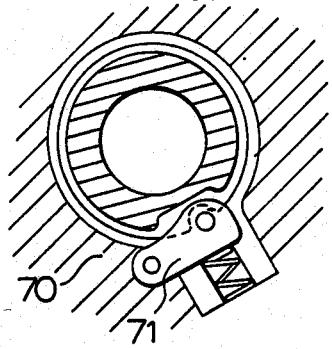
Figure 8A:
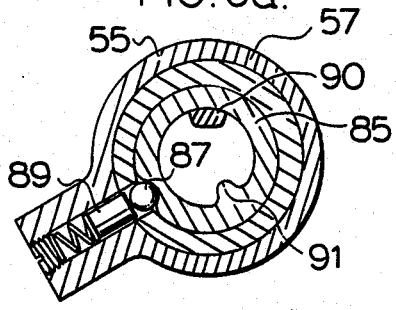
Figure 8B:
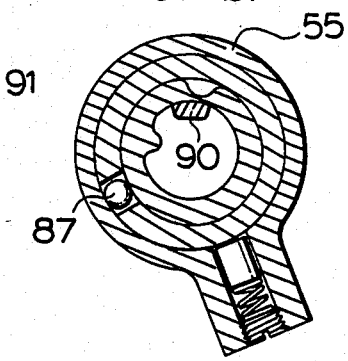

FIGS. 6*a*, 6*b* and 6*c* are cross sections on line 6—6 of FIG. 5, showing different orientations of the components;

FIGS. 7*a* and 7*b* are cross sections on line 7—7 of FIG. 5, showing different orientations of the components;

FIGS. 8 and 8*b* are cross sections on line 8—8 of FIG. 5, showing different orientations of the components.

Figure 1:
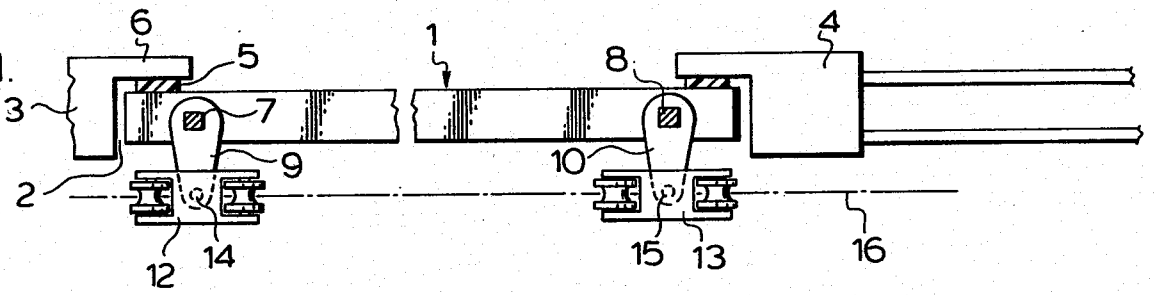

FIG. 1 shows a sliding door 1 closed into a recess 2 in the door frame between a jamb 3 and a mullion 4. The sliding door 1 compresses a weatherseal 5 against a lip 6 which lies around the recess 2.

Crankshafts 7 and 8 are mounted in the sliding door 1 for rotation about a vertical axis. Crank arms 9 and 10 are mounted on the sliding door 1, and the crank arms 9 and 10 are arranged to follow the crank shafts 7 and 8 as regards rotary motion about the said axis. the crank arms 9 and 10 are pinned to respective trolleys 12 and 13, which are arranged to roll back and forth on a slide track 16.

Figure 2:
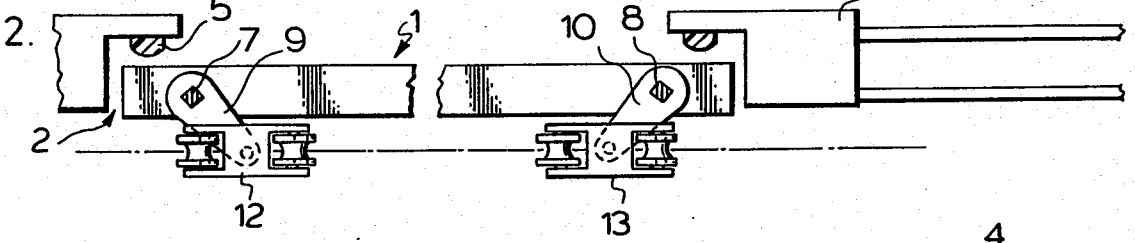
Figure 3:
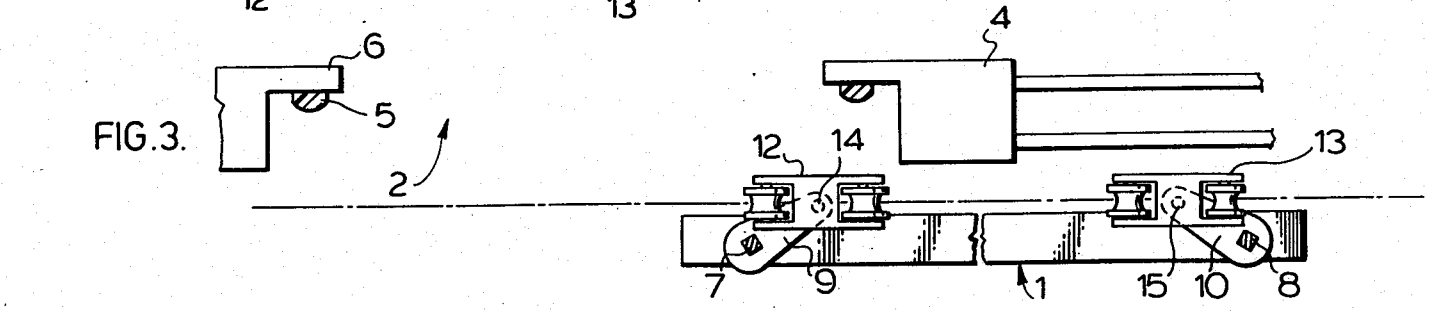

It can be seen from FIGS. 2 and 3 that when the crank shafts 7 and 8 rotate, the sliding door 1 moves out of the recess 2 far enough for the sliding door 1 to clear the mullion 4. At that point the sliding door 1 may be rolled along the slide track 16 on the trolleys 12 and 13.

Figure 4:
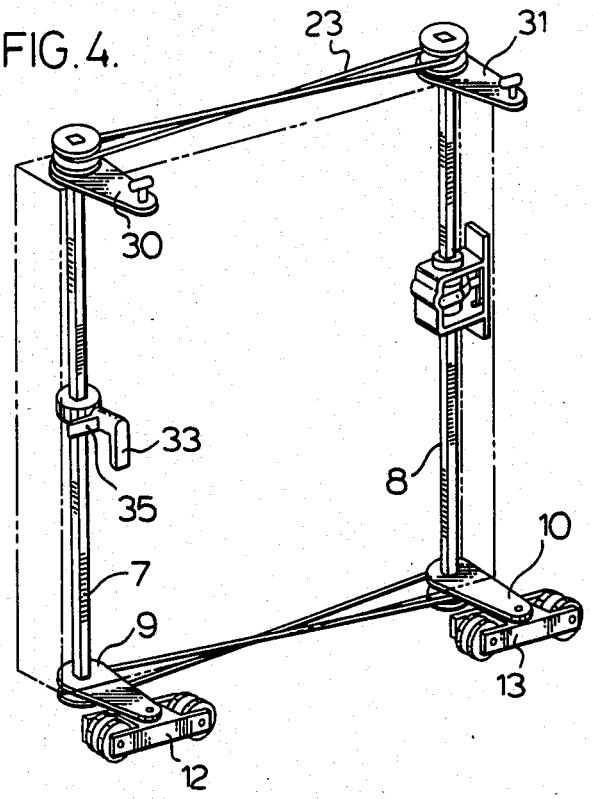
FIG. 4 is a pictorial view of a sliding door assembly.

FIG. 4 shows how the components are mounted on the sliding door 1.

The two crank shafts 7 and 8 are caused to rotate in unison (though in opposite senses) by means of drive cords 23. Corresponding crank arms 30 and 31 are provided at the top of the sliding door 1. These are provided to guide the top of the sliding door 1 in a complementary track, the weight of the sliding door 1 being taken by the crank arms 9 and 10 and trolleys 12 and 13.

The door 1 is provided with an inside handle 50 and an outside handle 51. FIG. 5 is a cross section through the axis of the handles 50 and 51.

A bevel gear 53 is mounted on the crank shaft 7. The bevel gear 53 is in constant mesh with a crank shaft drive piece 55. The crank shaft drive piece 55 is in two parts; an inside part 56 and an outside part 57. The two parts 56 and 57 are joined together by means of a rigid bar 59. The effect is that the two parts can only move in unison with each other, and the crank shaft 7 can only turn when the whole crank shaft drive piece 55 turns.

The crank shaft drive piece 55 is not connected in a fixed unitary manner with either of the two door handles 50 and 51 however. The design is such that both the handles are sometimes movable relative to the crank shaft drive piece 55, to lock the door either from the inside or from the outside.

The operation of locking the door from the inside may be described as follows. FIG. 6*a* shows the components when the inside handle 50 and the crank shaft drive piece are firmly fixed together, so that when the handle 50 moves the crank shaft 7 must rotate. This state of the components is termed the unlocked state.

FIG. 6*b* shows the components when the inside handle 50 and the crank shaft drive piece 55 are able to move relative to each other. This state is termed the locked state.

The inside handle 50 is annular in shape at the location of the FIG. 6 cross section, except that the annulus is interrupted by a hole 60 and a slot 61. The crank shaft drive piece 55 is provided with a through hole 63 at this location. A pin 65 and a ball 67 fit in the holes 60 and 63 and in the slot 61 in the manner shown. The pin 65 and the ball 67 also cooperate with a cam surface 69 which is formed in a body 70 attached to the jamb side of the door 1.

There is a lost motion connection between the inside handle 50 and the crank shaft drive piece 55 in that when the inside handle 50 is in the locked (FIG. 6*b*) state, the inside handle 50 is free to turn to the extent permitted by the dimensions of the slot 61.

FIG. 6*c* shows the changeover between the locked and the unlocked states.

It is arranged that the turning of the handle at this time is effective to actuate the locking means of the invention. This aspect is shown in FIG. 7.

A blocker piece is provided, comprising a pawl 71 which is pivoted to the body 70. The pawl 71 includes a peg 73, which co-operates with a slot 75 formed in the crank shaft drive piece 55. The pawl is moved into and out of the slot 75 by a cam 77, which is unitary with the inside handle 50. During the locked state of the inside handle, therefore, the act of turning the inside handle—as permitted by the dimensions of the slot 61—is effective to move the peg 73 into the slot 75 by cam action and thus to lock the crank shaft drive piece, and consequently the crank shaft 7 itself, to the body 70.

When the inside handle 50 is in the locked state, therefore, the outside part 57 of the crank shaft drive piece 55 cannot rotate, and thus the door cannot be opened by means of the outside handle 51.

FIG. 7*a* shows the peg 73 disengaged from the slot 75, and FIG. 7*b* shows the peg 73 entered into the slot 75. It will be noted that the inside handle 50 is at differing orientations in the two illustrations, since the inside handle can move during the locked state, whereas the crank shaft drive piece 55 has remained at the same orientation.

As shown, the pawl 71 will return to its FIG. 7*a* position, i.e., clear of the slot 75, under the action of a return spring. An alternative would be to provide another lobe on the cam 77, and to move the peg 73 out of the slot 75 by positive mechanical drive rather than by spring return. This alternative is preferred because it ensures a clean, positive action even if the mechanism has become somewhat worn, or iced up, for example.

The operation of the outside handle 51 may be described as follows. A cylinder type lock body 80 is keyed into the outside handle 51, and a barrel 81 of the lock is rotatable relative to the body 80—and hence relative to the outside handle 51—by means of a key.

FIG. 8*a* is a cross section that shows the positions of the components when the outside handle is unlocked, i.e., when the outside handle can be turned, and the outside handle is effective, upon being turned, to turn the crank shaft 7. The outside handle 51 and the outside part 57 of the crank shaft drive piece 55 are coupled together at this point.

Included in the assembly in the region of the outside handle 51 is a key follower 85, a ball 87, and a pin 89. To render the outside handle ineffective to turn the crank shaft 7, a key is used to turn the barrel 81. A tongue 90 on the barrel 81 picks up a ridge 91 in the follower 85, thus displacing the ball 87 and pin 89 as shown in FIG. 8*b*. Now, the outside handle swings freely, and cannot be used to turn the crank shaft.

The fact that the follower 85 has a lost motion connection, as shown, with the barrel 81 means that the barrel can turn a full 360° between its two key positions. Locks of the kind that rotate through a full circle generally tend to be more reliable and long lasting than locks that have a shorter range of travel. If a short travel lock were to be used, the follower 85 would not be needed, because the barrel 81 could be arranged to displace the ball 87 directly.

The inside handle 50 is provided with a latch bar 100, which is engageable with a latch slot in the door frame. Such a latch provides added security against the door being forced, whether the door is locked from the inside, from the outside, or both. It will be appreciated that the door handle arrangement as described uses a single simple swing of the handle not only to unlock the door, and not only to move the door automatically out of the recess, but also to unlatch the door handle. The invention thus provides a sliding door assembly of highly sophisticated performance, suitable for the highest quality patio doors; yet the components and the mechanism are not unduly complex.

What is claimed is:

1. A sliding door assembly, comprising:

a door, a slide track, and a door frame having a recess;

where the arrangement is such that, when the door is open the door is free to slide along the slide track, and when the door is closed the door is entered into the recess;

where, upon closing, the door moves bodily into the recess in a direction substantially at right angles relative to the slide track;

transmission means for moving the door in and out of the recess;

said door having an inside handle and an outside handle;

said handles bearing in operative engagement with said transmission means in such a manner that the act of turning the handles is effective generally to move the sliding door in and out of the recess;

door locking means associated with said inside handle, said inside handle being movable between an unlocked state and a locked state;

wherein, in said unlocked state either of the handles can be turned, and when turned either handle is effective to operate the transmission means thereby to move the sliding door in and out of the recess;

said locking means being activated when, and only when, the inside handle is in the locked state and being then effective to preclude turning motion of the outside handle from actuating the transmission means, whereby the outside handle is then ineffective to move the sliding door in and out of the recess.

2. Assembly of claim 1, wherein said inside handle is mounted for movement in an arc relative to the sliding door;

where one sector of the arc comprises said locked state; and where the remaining sector of the arc comprises said unlocked state.

3. The assembly as set forth in claim 1, said outside handle having a key actuatable lock therein connecting said outside handle to said transmission means, whereby in a locked state the connection to the transmission means is disabled and the handle can move freely without the transmission of movement therefrom to said transmission means.

4. Assembly of claim 1, wherein said transmission means includes a pair of crank arms which, on being rotated, are effective to move said door in and out of the recess;

said crank arms being rotated by means of a crank shaft.

5. Assembly of claim 4, wherein said transmission means includes a crank shaft drive piece;

and where said crank shaft and the crank shaft drive piece are in continuous engagement in such a manner that rotation of one results always in rotation of the other.

6. Assembly of claim 5, said inside handle is coupled to said crank shaft drive piece by means of a lost motion connection;

where, when the inside handle is in said unlocked state, the lost motion connection is effective to transmit a motion of the inside handle to the crank shaft drive piece;

and where, when the inside handle is in said locked state, the lost motion connection permits a motion of the inside handle to take place without that motion being transmitted to the crank shaft drive piece.

7. Assembly of claim 6, wherein said locking means comprises a blocker piece which is engageable with said crank shaft drive piece, and which, when so engaged, is effective to block movement of the crank shaft drive piece;

the blocker piece being in blocking engagement with the crank shaft drive piece when, and only when, the inside handle is in said locked state.

8. Assembly of claim 7, where a cam is provided for moving said blocker piece in and out of said blocking engagement;

and where the cam is actuated upon said inside handle being moved from said unlocked state to said locked state.

* * * * *